US011852452B2

(12) United States Patent
Biafore, Jr.

(10) Patent No.: US 11,852,452 B2
(45) **Date of Patent: *Dec. 26, 2023**

(54) BALLISTIC BARREL CLEANING CARTRIDGE

(71) Applicant: Midwest Outdoor Holdings LLC, Commerce Township, MI (US)

(72) Inventor: John Biafore, Jr., Grand Blanc, MI (US)

(73) Assignee: Midwest Outdoor Holdings LLC, Detroit, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/708,285

(22) Filed: Mar. 30, 2022

(65) Prior Publication Data

US 2022/0221256 A1 Jul. 14, 2022

Related U.S. Application Data

(63) Continuation-in-part of application No. 17/118,495, filed on Dec. 10, 2020, now Pat. No. 11,293,726.

(60) Provisional application No. 62/946,693, filed on Dec. 11, 2019.

(51) Int. Cl.
*F42B 5/24* (2006.01)

(52) U.S. Cl.
CPC ..... *F42B 5/24* (2013.01)

(58) Field of Classification Search
CPC ..... F42B 5/24
See application file for complete search history.

(56) References Cited

U.S. PATENT DOCUMENTS 115,498 A * 5/1871 Milbank ..... F42B 14/061 102/521
627,929 A * 6/1899 Andrews ..... F42B 14/04 102/511
1,044,360 A * 11/1912 Du Bois ..... F42B 14/02 102/526
2,884,836 A * 5/1959 Allen ..... E21B 43/116 175/3.5
3,142,256 A * 7/1964 Mack ..... F42B 12/78 102/508
3,208,387 A * 9/1965 Giles ..... F42B 5/24 102/511

(Continued)

*Primary Examiner* — Derrick R Morgan
(74) *Attorney, Agent, or Firm* — Howard & Howard Attorneys PLLC

(57) ABSTRACT

A ballistic barrel cleaning cartridge is provided. The ballistic barrel cleaning cartridge includes a casing including a casing recess. The casing recess is closed at a first end of the casing. The cartridge further includes a propellant disposed within the casing recess and an abrasive-binding agent composite slug constructed with an abrasive agent and a polymerized binding agent. The abrasive-binding agent composite slug is disposed within the casing recess at a second end of the casing. The abrasive-binding agent composite slug includes a bore forward recess configured for receiving a bore forward high-density weight and a retention lip configured for retaining the bore forward high-density weight within the bore forward recess. The cartridge further includes the bore forward high-density weight. Expansion of the propellant is operable to expel the abrasive-binding agent composite slug from the casing recess.

18 Claims, 13 Drawing Sheets

(56) References Cited

U.S. PATENT DOCUMENTS 3,468,216 A * 9/1969 Charpentier ..... F41A 21/16 89/14.05
3,476,047 A * 11/1969 Davis ..... F42B 5/24 102/442
3,707,411 A * 12/1972 Gawlick ..... C06B 25/22 149/19.8
4,503,777 A * 3/1985 Young ..... F42B 12/80 102/514
5,086,703 A * 2/1992 Klein ..... F42B 5/02 102/444
5,097,767 A * 3/1992 Cirillo ..... F42B 10/46 102/517
5,233,128 A * 8/1993 Lai ..... F42B 5/24 102/529
6,085,454 A * 7/2000 Caudle ..... F42B 14/06 42/51
6,186,071 B1 * 2/2001 Fry ..... F42B 12/78 102/515
6,389,978 B1 * 5/2002 Hooper ..... F42B 5/24 42/95
6,405,654 B1 * 6/2002 Smith ..... F42B 12/34 102/501
6,668,480 B1 * 12/2003 Riley ..... F41A 29/00 42/95
7,380,505 B1 * 6/2008 Shiery ..... F42B 12/34 102/524
7,743,706 B1 * 6/2010 Lai ..... F42B 5/24 42/95
9,046,332 B2 * 6/2015 Peterson ..... F42B 14/064
9,175,939 B1 * 11/2015 Wilfong ..... F42B 5/105
10,480,916 B1 * 11/2019 Saltz ..... F42B 14/064
11,112,223 B2 * 9/2021 Whitworth ..... F42B 5/24
11,293,726 B2 * 4/2022 Biafore, Jr. ..... F42B 5/24
2002/0129725 A1 * 9/2002 Bice ..... F42B 5/24 102/442
2010/0095863 A1 * 4/2010 Kolnik ..... F42B 14/064 102/502
2014/0090284 A1 * 4/2014 Peterson ..... F41C 7/11 42/51
2014/0109791 A1 * 4/2014 Whitworth ..... F42B 7/08 102/529
2014/0290111 A1 * 10/2014 Rogers ..... F41A 29/02 42/90
2014/0331886 A1 * 11/2014 Whitworth ..... F42B 14/00 102/529
2016/0091289 A1 * 3/2016 Peterson ..... F41C 9/08 102/501
2018/0274888 A1 * 9/2018 Whitworth ..... F41A 29/02
2019/0128652 A1 * 5/2019 Whitworth ..... F42B 5/00
2019/0154414 A1 * 5/2019 Whitworth ..... F42B 5/24
2021/0055068 A1 * 2/2021 Calvete ..... F41C 9/08
2021/0231418 A1 * 7/2021 Whitworth ..... F42B 5/24
2021/0254919 A1 * 8/2021 Billings ..... F41A 21/18
2021/0254954 A1 * 8/2021 Billings ..... F41A 21/18
2021/0270586 A1 * 9/2021 Maricaille ..... F42B 7/08
2022/0049942 A1 * 2/2022 Peterson ..... F42B 5/24
2023/0044162 A1 * 2/2023 Maurer ..... F42B 10/06

* cited by examiner

BALLISTIC BARREL CLEANING CARTRIDGE

CROSS-REFERENCE TO RELATED APPLICATIONS

This disclosure is a continuation-in-part of U.S. patent application Ser. No. 17/118,495 filed on Dec. 10, 2020, which claims priority to Provisional Patent Application No. 62/946,693 filed on Dec. 11, 2019, both of which are hereby incorporated by reference.

TECHNICAL FIELD

This disclosure relates to a ballistic barrel cleaning cartridge, and, more particularly, to a disposable ballistic barrel cleaning cartridge which cleans a bore of a barrel of a firearm when fired.

BACKGROUND

The statements in this section merely provide background information related to the present disclosure. Accordingly, such statements are not intended to constitute an admission of prior art.

Shotguns, long guns, handguns, and other firearms are well known tools and recreational instruments. Best practice includes cleaning firearm and ballistic barrels regularly in order to keep the gun in the best condition possible for accurate shooting. One of the main components of a firearm that may be cleaned is a bore of the barrel. In fact, the bore may be cleaned after each use; which may be a bothersome and time-consuming task. Because of this, firearm owners may not clean their firearm bores.

SUMMARY

A ballistic barrel cleaning cartridge is provided. The ballistic barrel cleaning cartridge includes a casing including a casing recess, a propellant disposed within the casing recess, an abrasive-binding agent composite slug constructed with an abrasive agent and a polymerized binding agent, and a bore forward high-density weight. The casing recess is closed at a first end of the casing. The abrasive-binding agent composite slug is disposed within the casing recess at a second end of the casing. The abrasive-binding agent composite slug includes a bore forward recess configured for receiving the bore forward high-density weight and a retention lip configured for retaining the bore forward high-density weight within the bore forward recess. Expansion of the propellant is operable to expel the abrasive-binding agent composite slug from the casing recess.

In some embodiments, the abrasive agent includes fiberglass.

In some embodiments, the abrasive agent includes glass.

In some embodiments, the polymerized binding agent includes nylon.

In some embodiments, the polymerized binding agent includes one of acrylonitrile butadiene styrene, polypropylene, or polyethylene.

In some embodiments, the bore forward high-density weight includes a per unit volume greater than a mass per unit volume of the abrasive-binding agent composite slug.

In some embodiments, a rear portion of the abrasive-binding agent composite slug is concave.

In some embodiments, the abrasive agent is interspersed within the polymerized binding agent.

In some embodiments, the casing recess is cylindrically shaped, and the abrasive-binding agent composite slug is cylindrically shaped.

In some embodiments, the bore forward high-density weight includes a recess configured for engaging with the retention lip.

In some embodiments, the bore forward high-density weight includes a pointed tip configured for enabling the ballistic barrel cleaning cartridge to be fed into a chamber of a firearm.

In some embodiments, the bore forward recess is conical-shaped.

In some embodiments, the bore forward recess is cylindrically-shaped.

According to one alternative embodiment, a ballistic barrel cleaning cartridge is provided. The ballistic barrel cleaning cartridge includes a casing including a casing recess, a propellant disposed within the casing recess, an abrasive-binding agent composite slug constructed with an abrasive agent and a polymerized binding agent, and a bore forward high-density weight. The casing recess is closed at a first end of the casing. The abrasive-binding agent composite slug is disposed within the casing recess at a second end of the casing. The abrasive-binding agent composite slug includes a bore forward recess configured for receiving the bore forward high-density weight and a retention lip configured for retaining the bore forward high-density weight within the bore forward recess. Expansion of the propellant is operable to expel the abrasive-binding agent composite slug from the casing recess. The abrasive agent includes one of fiberglass or glass. The polymerized binding agent includes one of nylon, acrylonitrile butadiene styrene, polypropylene, or polyethylene.

In some embodiments, the abrasive agent is interspersed within the polymerized binding agent.

In some embodiments, the casing recess is cylindrically shaped, and the abrasive-binding agent composite slug is cylindrically shaped.

In some embodiments, the bore forward metallic weight includes a recess configured for engaging with the retention lip.

In some embodiments, the bore forward metallic weight includes a pointed tip configured for enabling the ballistic barrel cleaning cartridge to be fed into a chamber of a firearm.

BRIEF DESCRIPTION OF THE DRAWINGS

One or more embodiments will now be described, by way of example, with reference to the accompanying drawings, in which.

DETAILED DESCRIPTION

Figure 2:
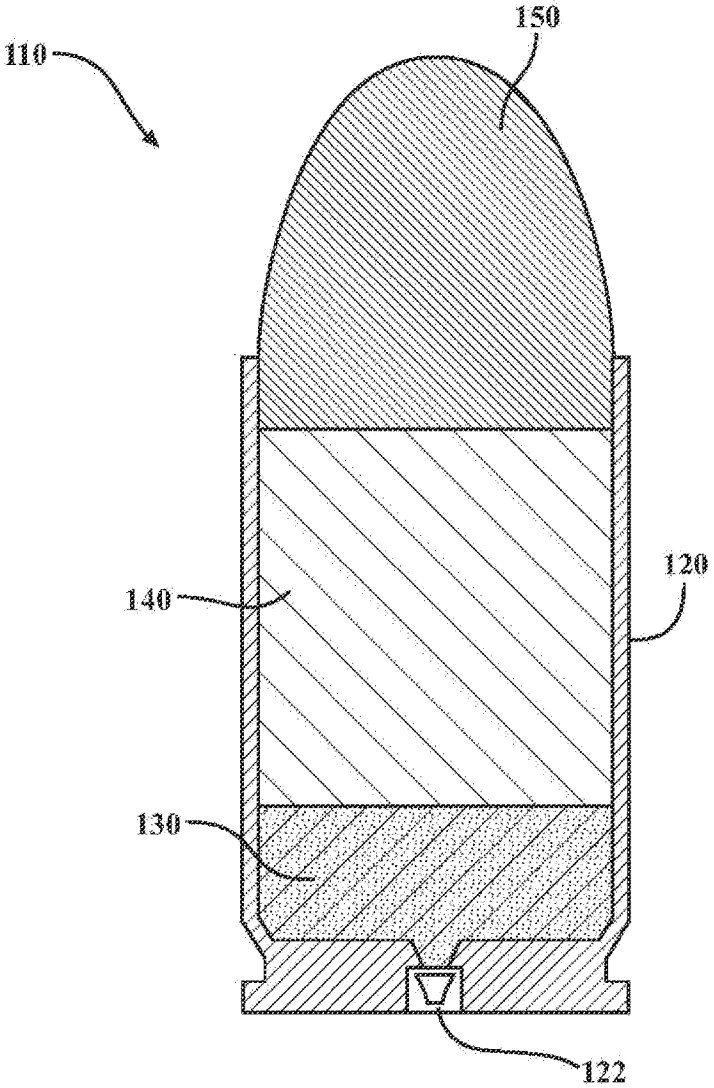
FIG. 2 schematically illustrates in cross sectional view a second exemplary embodiment of a ballistic barrel cleaning cartridge, including a high-density weight including a bullet portion, in accordance with the present disclosure.

Reference throughout this specification to "one embodiment," "an embodiment," or similar language means that a particular feature, structure, or characteristic described in connection with the embodiment is included in at least one embodiment of the subject matter of the present disclosure. Appearances of the phrases "in one embodiment," "in an embodiment," and similar language throughout this specification may, but do not necessarily, refer to the same embodiment.

As used in the description herein and throughout the claims, the following terms take the meanings explicitly associated herein, unless the context clearly dictates otherwise: the meaning of "a," "an," and "the" includes plural reference, the meaning of "in" includes "in" and "on." The term "based upon" is not exclusive and allows for being based on additional factors not described, unless the context clearly dictates otherwise. Additionally, in the subject description, the word "exemplary" is used to mean serving as an example, instance or illustration. Any embodiment or design described herein as "exemplary" is not necessarily to be construed as preferred or advantageous over other embodiments or designs. Rather, use of the word exemplary is intended to present concepts in a concrete manner.

Various embodiments of the present disclosure will be described in detail with reference to the drawings, where like reference numerals represent like parts and assemblies throughout the several views. Reference to various embodiments does not limit the scope of the disclosure. Additionally, any examples set forth in this specification are not intended to be limiting and merely set forth some of the many possible embodiments for the claimed disclosure.

In many ballistic barrels of a firearm, a cartridge or casing is loaded directly into a breach portion of a bore of the barrel. Firing rounds leaves residue and debris on the bore surface. This residue and debris may build up through extended and repeated use without appropriate cleaning. When cleaning, a ballistic barrel cleaning cartridge may be loaded into the bore. A user may then actuate a trigger on the firearm to fire the ballistic barrel cleaning cartridge. The firing of the cleaning cartridge or bullet allows a cleaning projectile including cleaning material to be moved through the bore in a compressed state, as will be discussed in more detail below.

A ballistic bore cleaning cartridge is provided which includes a composite slug, i.e., a slug having two or more materials in the slug. According to one embodiment, an abrasive or scrubbing agent is mixed with and held in place by a binding agent. Various abrasive-binding agent composite slugs are envisioned. In one embodiment, a glass filled polymer is one example of an abrasive-binding agent composite slug that may be used in a ballistic bore cleaning cartridge. In one non-limiting example, a 30% glass/70% nylon material may be used to create an abrasive-binding agent composite slug. In another embodiment, a brass shaving filled polymer, such as acrylonitrile butadiene styrene (ABS), polypropylene, or polyethylene, is another example of an abrasive-binding agent composite slug that may be used in a ballistic bore cleaning cartridge. In another embodiment, a glass filled cork material is another example of an abrasive-binding agent composite slug that may be used in a ballistic bore cleaning cartridge.

Materials may be used for the abrasive agent that are softer than steel used to construct ballistic barrels. Softer materials will not scratch or significantly wear the steel material of the bore.

Materials in the abrasive-binding agent composite slug may be uniformly mixed and distributed within the abrasive-binding agent composite slug. In one embodiment, two or more parts may be formed or secured together to provide advantageous properties to the slug. For example, a high-density or metallic weight may be inset within an injection molded slug, with the metallic weight providing back pressure within the bore as the slug is propelled down the bore, with the injection molded material around the inset metallic weight including an exemplary glass filled polymer. In one exemplary embodiment, a portion of the abrasive-binding agent composite slug may form a bore forward cup in which metallic pellets, a metallic paste, or other dense material may be loaded for the purpose of providing back pressure upon the slug as the slug is propelled down the bore.

The disclosed device includes a formulation of components designed to optimize cleaning and improve an ability to load the device into a chamber of a firearm. The device may readily be modified to accommodate multiple cartridge configurations, calibers, firearm types, etc.

Figure 1:
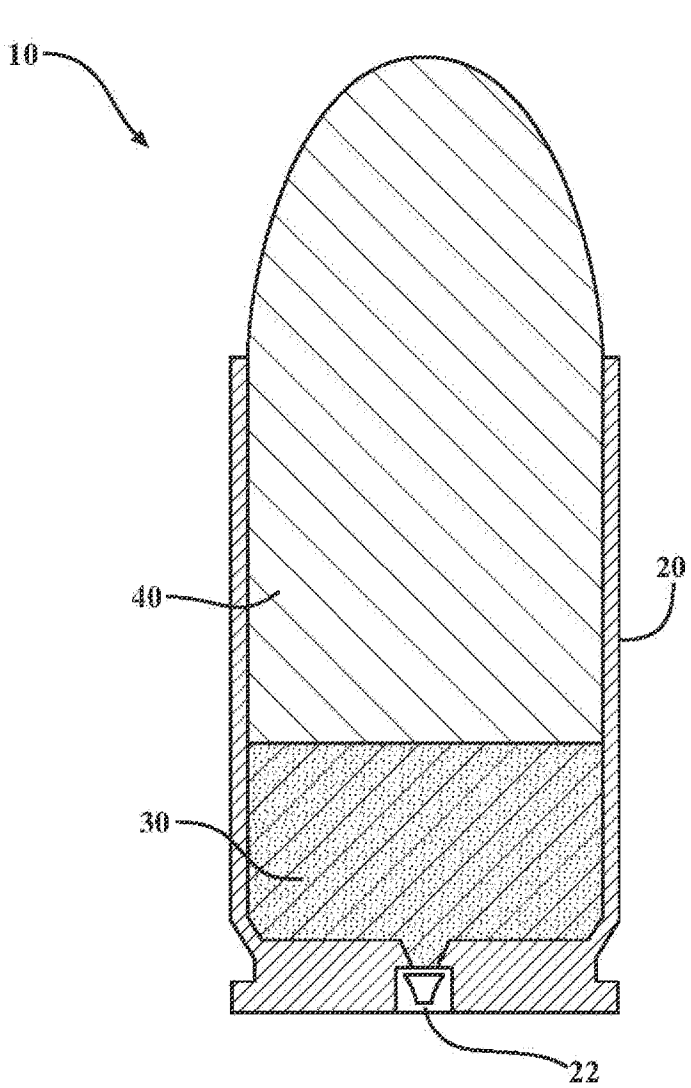
FIG. 1 schematically illustrates in cross sectional view a first exemplary embodiment of a ballistic barrel cleaning cartridge operable to be used in an exemplary firearm, in accordance with the present disclosure.

Referring now to the drawings, wherein the showings are for the purpose of illustrating certain exemplary embodiments and not for the purpose of limiting the same, FIG. 1 schematically illustrates in cross sectional view a first exemplary embodiment of a ballistic barrel cleaning cartridge configured for use in an exemplary firearm such as a pistol or a rifle. A ballistic barrel cleaning cartridge 10 is illustrated, including casing 20, propellant 30, and abrasive-binding agent composite slug 40. Casing 20 may be made of brass, steel, or any other material known in the art for ammunition casings. Casing 20 may be described to include a closed end at first end 23. Casing 20 includes a casing recess 24 which is cylindrically shaped. The casing recess 24 may be described as an open end at a second end 21 of the casing 20, a walled-in enclosure with an open end, or a concave region of the casing 20. Casing 20 may include a primer 22 operable to create a spark when struck by a firing pin of a firearm. Casing 20 may be a centerfire casing or, alternatively, a rimfire casing. The abrasive-binding agent composite slug 40 is illustrated within the casing recess 24 of the casing 20 and may include an abrasive agent, for example, including glass or fiberglass particles. The propellant 30 is also illustrated within the casing recess 24. The abrasive-binding agent composite slug 40 may additionally include a polymerized binding agent. The abrasive agent may be interspersed within the binding agent. The abrasive agent is operable to clean or scrub an inside of a bore of a firearm when propelled down the bore, the exemplary glass or fiberglass particles scraping along the bore and dislodging contaminant particles therefrom.

Propellant 30 may include chemical compositions available in the art configured to rapidly or explosively expand as a spark is introduced and may include, in one non-limiting embodiment, gunpowder.

Abrasive-binding agent composite slug 40 is illustrated including a single piece slug configured to imitate an overall shape of a bullet. A proportion of the size of abrasive-binding agent composite slug 40 to propellant 30 (i.e. how much of the volume of casing 20 is taken up by the propellant vs. the slug) is variable depending upon selectable properties of the slug and the propellant, and the proportions of abrasive-binding agent composite slug 40 and propellant 30 are provided as examples. As abrasive-binding agent composite slug 40 is propelled down the bore of a firearm, it becomes a cleaning projectile.

FIG. 2 schematically illustrates in cross sectional view a second exemplary embodiment of a ballistic barrel cleaning cartridge, including a high-density bullet portion. Ballistic barrel cleaning cartridge 110 is illustrated, including casing 120, primer 122, propellant 130, abrasive-binding agent composite slug 140, and an exemplary high-density weight embodied as bullet 150. The abrasive-binding agent composite slug 140 is illustrated within a cylindrical casing recess 124 of the casing 120. Propellant 130 is also illustrated with the cylindrical casing recess 124 of the casing 120. A high-density weight or insert may be defined as including a mass per unit volume greater than a mass per unit volume of the abrasive-binding agent composite slug. Ballistic barrel cleaning cartridge 110 is similar to ballistic barrel cleaning cartridge 10 with the exception that bullet 150 provides back pressure within the bore of the firearm. Whereas abrasive-binding agent composite slug 40 of FIG. 1 may be relatively lightweight or low mass, a high-density weight or metallic bullet such as bullet 150 is relatively higher mass, so the expanding gas created by igniting propellant 130 takes longer to accelerate bullet 150 and abrasive-binding agent composite slug 140 down the bore of the firearm than just abrasive-binding agent composite slug 40 by itself. Back pressure within the bore acting upon abrasive-binding agent composite slug 140 can, in some embodiments, be useful, for example, to cause abrasive-binding agent composite slug 140 to deform, expand, or otherwise to press outwardly against the bore when propelled through the barrel.

Figure 3:
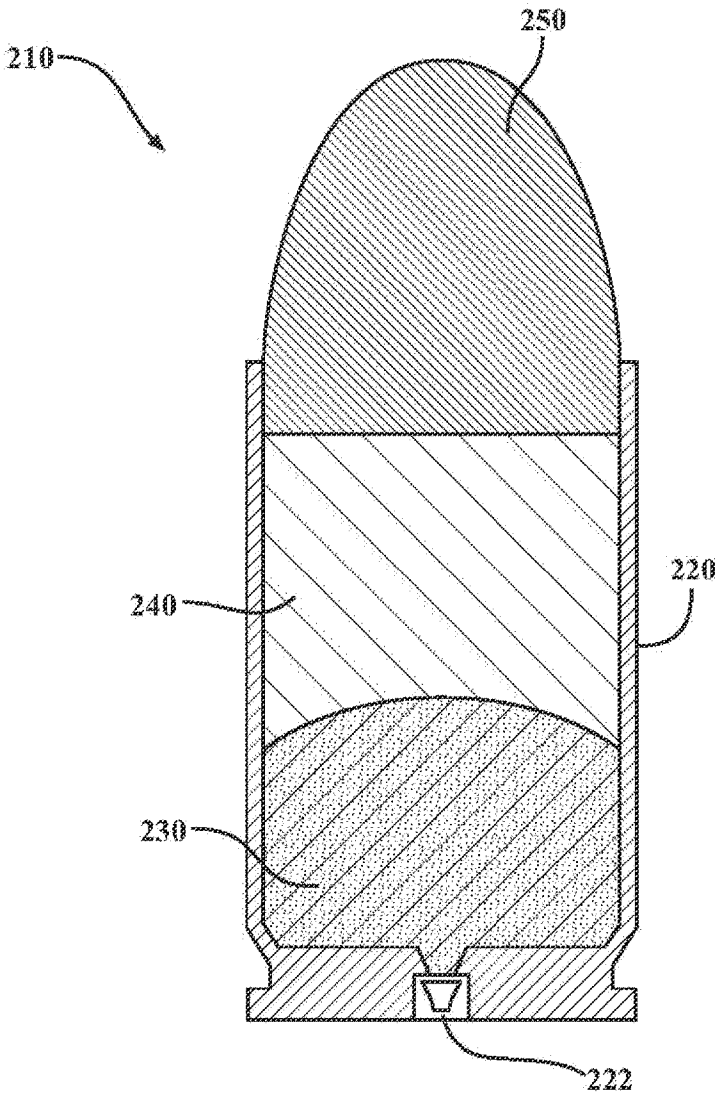
FIG. 3 schematically illustrates in cross sectional view a third exemplary embodiment of a ballistic barrel cleaning cartridge, including a bullet portion and an abrasive-binding agent composite slug including a gas seal portion, in accordance with the present disclosure.

FIG. 3 schematically illustrates in cross sectional view a third exemplary embodiment of a ballistic barrel cleaning cartridge, including a bullet portion and an abrasive-binding agent composite slug including a gas seal portion. Ballistic barrel cleaning cartridge 210 is illustrated, including casing 220, primer 222, propellant 230, abrasive-binding agent composite slug 240, and a high-density weight embodied as bullet 250. Ballistic barrel cleaning cartridge 210 is similar to ballistic barrel cleaning cartridge 110 of FIG. 2, with an exception that a bottom surface of abrasive-binding agent composite slug 240 is concave. This concavity enables abrasive-binding agent composite slug 240 to deform outwardly against the bore and seal the expanding gases of the propellant 230 from escaping past the abrasive-binding agent composite slug 240. This outward deformation additionally adds to the wiping capacity of the cleaning projectile.

Figure 4:
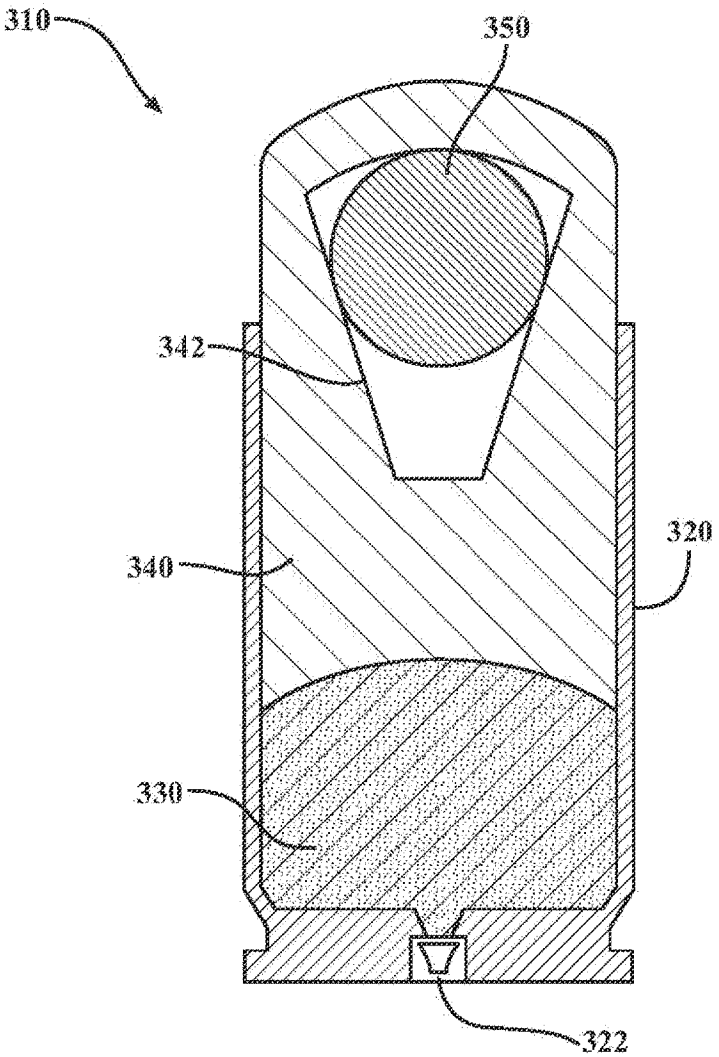
FIG. 4 schematically illustrates in cross sectional view a fourth exemplary embodiment of a ballistic barrel cleaning cartridge, including an abrasive-binding agent composite slug including a molded-in metallic weight and a bore forward conical recess, in accordance with the present disclosure.

FIG. 4 schematically illustrates in cross sectional view a fourth exemplary embodiment of a ballistic barrel cleaning cartridge, including an abrasive-binding agent composite slug including a molded-in high-density weight or metallic weight and a bore forward conical recess. Ballistic barrel cleaning cartridge 310 is illustrated, including casing 320, primer 322, propellant 330, abrasive-binding agent composite slug 340, and molded-in metallic weight 350. Abrasive-binding agent composite slug 340 includes a bore forward conical recess 342. Metallic weight 350 is initially positioned at a top/widest portion of the conical recess 342. As abrasive-binding agent composite slug 340 is propelled down the bore, a force of inertia on metallic weight 350 will cause metallic weight 350 to move bore rearward in comparison to abrasive-binding agent composite slug 340, such that metallic weight 350 will be wedged down into the narrower portion of conical recess 342. This wedging of metallic weight 350 into conical recess 342 will force the walls of abrasive-binding agent composite slug 340 outward radially against the bore.

Metallic weight 350 will similarly cause increased back pressure within the bore as compared to abrasive-binding agent composite slug 340 if no metallic weight 350 were present. Metallic weight 350 is exemplary. Metallic weight 350 may be replaced by a small stone, a ceramic ball, or any other similar shaped object with relatively higher density than abrasive-binding agent composite slug 340.

Figure 5:
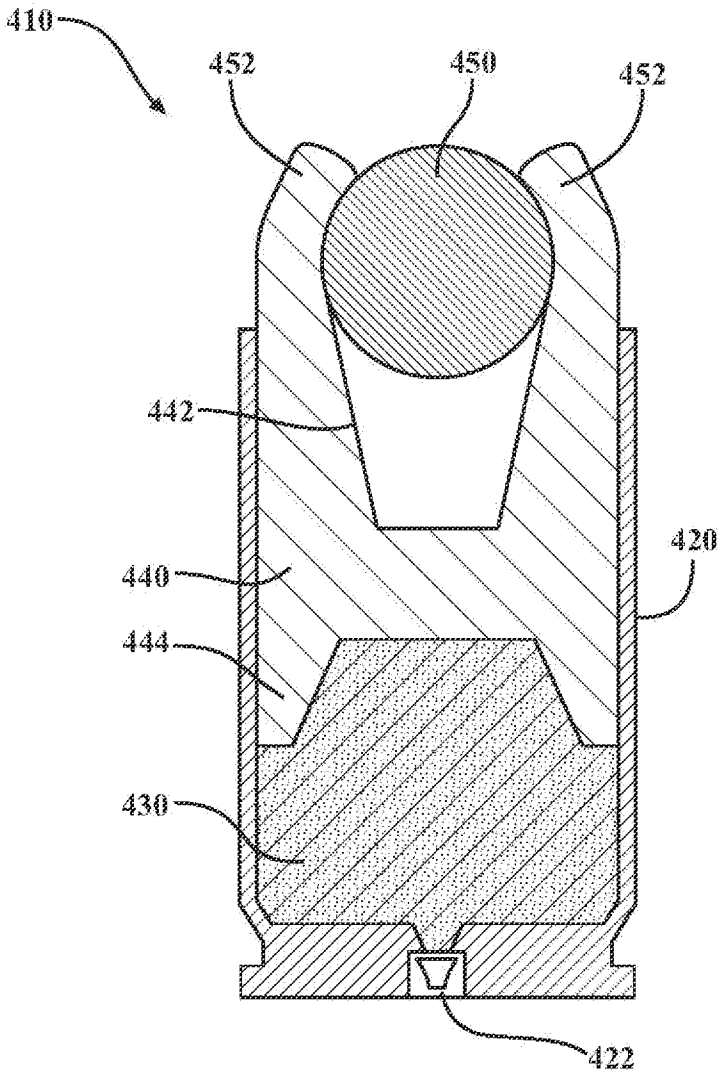
FIG. 5 schematically illustrates in cross sectional view a fifth exemplary embodiment of a ballistic barrel cleaning cartridge, including a bore forward metallic weight and an abrasive-binding agent composite slug including a bore forward conical recess and partial encapsulation of the bore forward metallic weight, in accordance with the present disclosure.

FIG. 5 schematically illustrates in cross sectional view a fifth exemplary embodiment of a ballistic barrel cleaning cartridge, including a bore forward metallic weight and an abrasive-binding agent composite slug including a bore forward conical recess and partial encapsulation of the bore forward metallic weight. Ballistic barrel cleaning cartridge 410 is illustrated, including casing 420, primer 422, propellant 430, abrasive-binding agent composite slug 440, and bore forward metallic weight 450. Abrasive-binding agent composite slug 440 includes bore forward conical recess 442. Ballistic bore cleaning cartridge 410 is similar to ballistic bore cleaning cartridge 310 of FIG. 4, with an exception that bore forward metallic weight 450 is partially encapsulated by front portion 452 of abrasive-binding agent composite slug 440. The front portion 452 may be described as a retention lip configured for retaining the bore forward metallic weight within the bore forward conical recess 442. In one embodiment, during initial assembly, bore forward metallic weight may be snappingly pressed within front portion 452 through the open front end of abrasive-binding agent composite slug 440. Rear portion 444 of abrasive-binding agent composite slug 440 includes a sharp-edge form gas seal.

Figure 6:
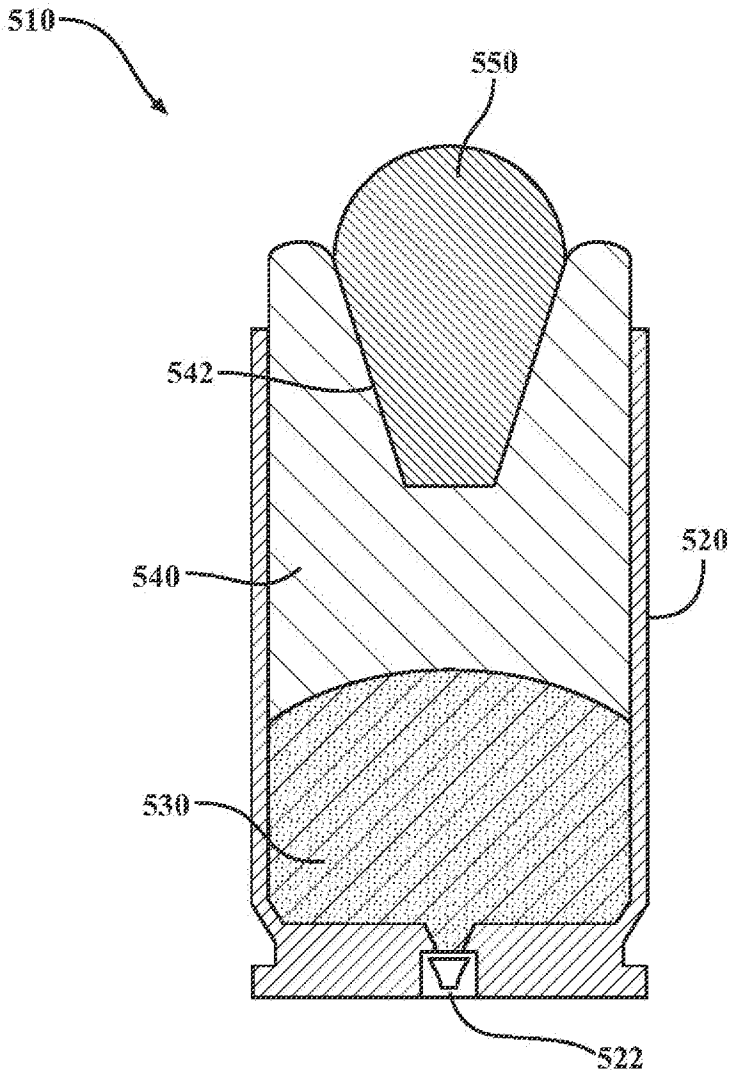
FIG. 6 schematically illustrates in cross sectional view a sixth exemplary embodiment of a ballistic barrel cleaning cartridge, including an alternative embodiment of a bore forward metallic weight and an abrasive-binding agent composite slug including a bore forward conical recess, in accordance with the present disclosure.

FIG. 6 schematically illustrates in cross sectional view a sixth exemplary embodiment of a ballistic barrel cleaning cartridge, including an alternative embodiment of a bore forward metallic weight and an abrasive-binding agent composite slug including a bore forward conical recess. Ballistic barrel cleaning cartridge 510 is illustrated, including casing 520, primer 522, propellant 530, abrasive-binding agent composite slug 540, and bore forward metallic weight 550. Abrasive-binding agent composite slug 540 includes bore forward conical recess 542. Ballistic bore cleaning cartridge 510 is similar to ballistic bore cleaning cartridge 410 of FIG. 5, with an exception that bore forward metallic weight 550 does not include a notch, and, therefore, it is relatively easier for metallic weight 550 to be wedged down within a narrower portion of bore forward conical recess 542.

Figure 8:
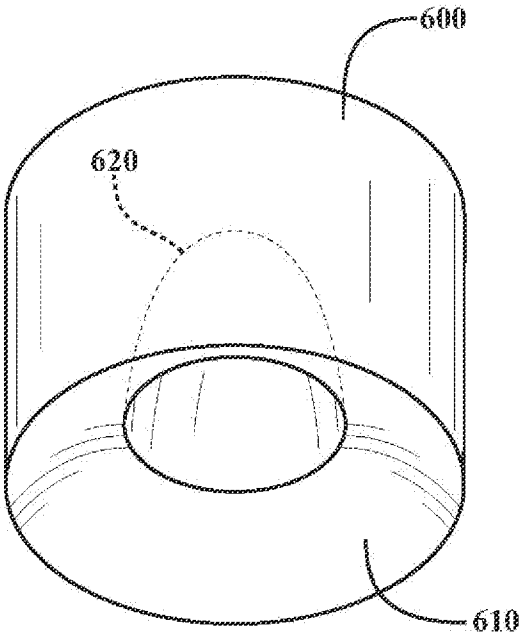
FIG. 8 illustrates in bottom perspective view the abrasive-binding agent composite slug of FIG. 7, in accordance with the present disclosure.
Figure 7:
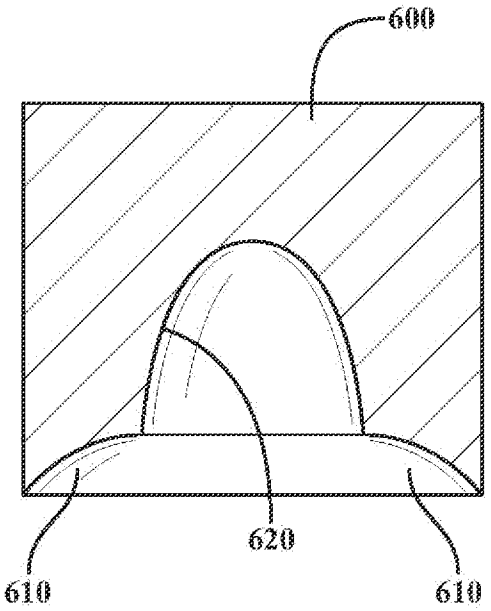
FIG. 7 schematically illustrates in cross sectional view an alternative embodiment of an abrasive-binding agent composite slug, in accordance with the present disclosure.

FIG. 7 schematically illustrates in cross sectional view an alternative embodiment of an abrasive-binding agent composite slug. Abrasive-binding agent composite slug 600 is illustrated, including an annular ring depression 610 operable to enable abrasive-binding agent composite slug 600 to act as a gas seal. Further, abrasive-binding agent composite slug 600 includes a hollow bottom portion 620. Expanding gas from a propellant pressing against and within hollow bottom portion 620 causes the side walls of abrasive-binding agent composite slug 600 to deform and press outwardly against the bore. FIG. 8 illustrates in bottom perspective view the abrasive-binding agent composite slug of FIG. 7. Abrasive-binding agent composite slug 600 is illustrated including annular ring depression 610 and hollow bottom portion 620.

Figure 9:
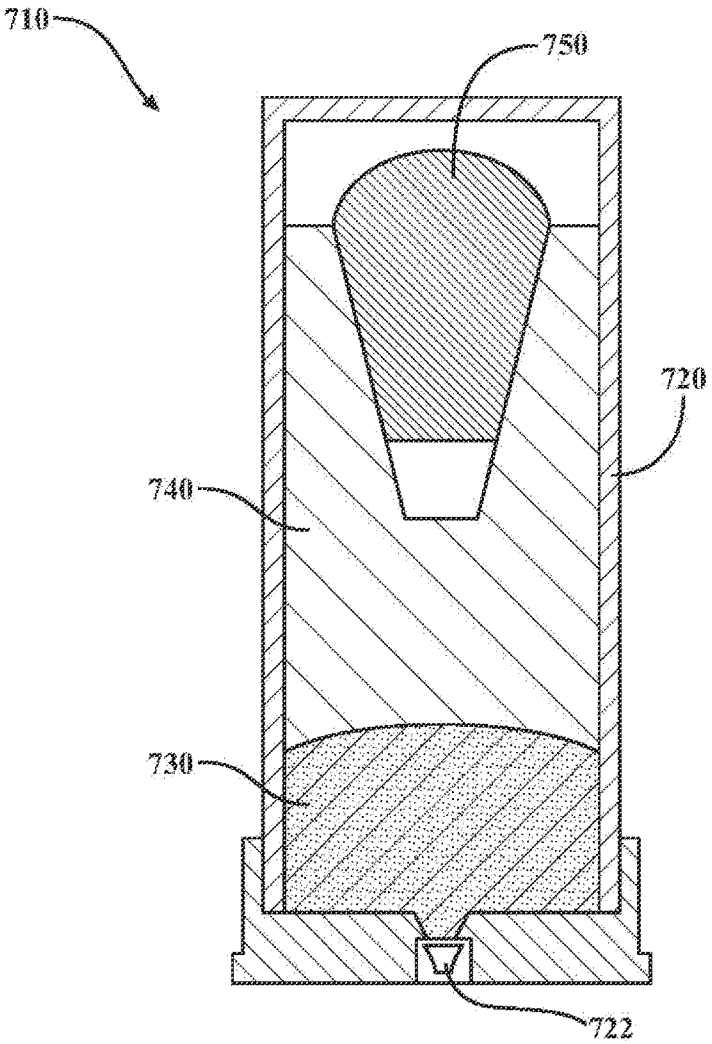
FIG. 9 schematically illustrates in cross sectional view an exemplary embodiment of a ballistic barrel cleaning cartridge operable to be used in an exemplary smooth-bore device, in accordance with the present disclosure.

FIG. 9 schematically illustrates in cross sectional view an exemplary embodiment of a ballistic barrel cleaning cartridge configured for use in an exemplary smooth-bore device such as a shotgun. Ballistic barrel cleaning cartridge 710 is illustrated, including casing 720, primer 722, propellant 730, abrasive-binding agent composite slug 740, and bore forward weight 750. Abrasive-binding agent composite slug 740 may be modified to include any features of other slugs described herein, for example, including features of slugs in FIG. 3, 4, 5, or 6.

Figure 10:
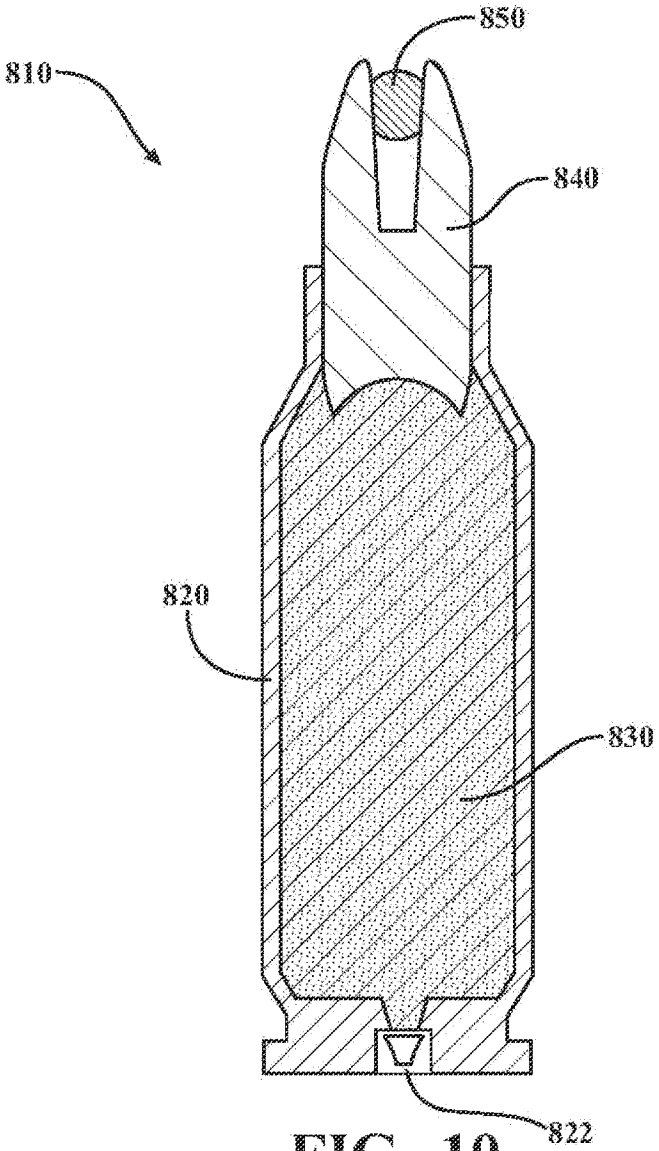
FIG. 10 schematically illustrates in cross sectional view an exemplary embodiment of a ballistic barrel cleaning cartridge embodied as a cartridge including a bottleneck casing operable to be used in an exemplary firearm, in accordance with the present disclosure.

FIG. 10 schematically illustrates in cross sectional view an exemplary embodiment of a ballistic barrel cleaning cartridge embodied as a cartridge including a bottleneck casing configured for use in an exemplary firearm. Ballistic barrel cleaning cartridge 810 is illustrated, including casing 820, primer 822, propellant 830, abrasive-binding agent composite slug 840, and bore forward weight 850.

Figure 11:
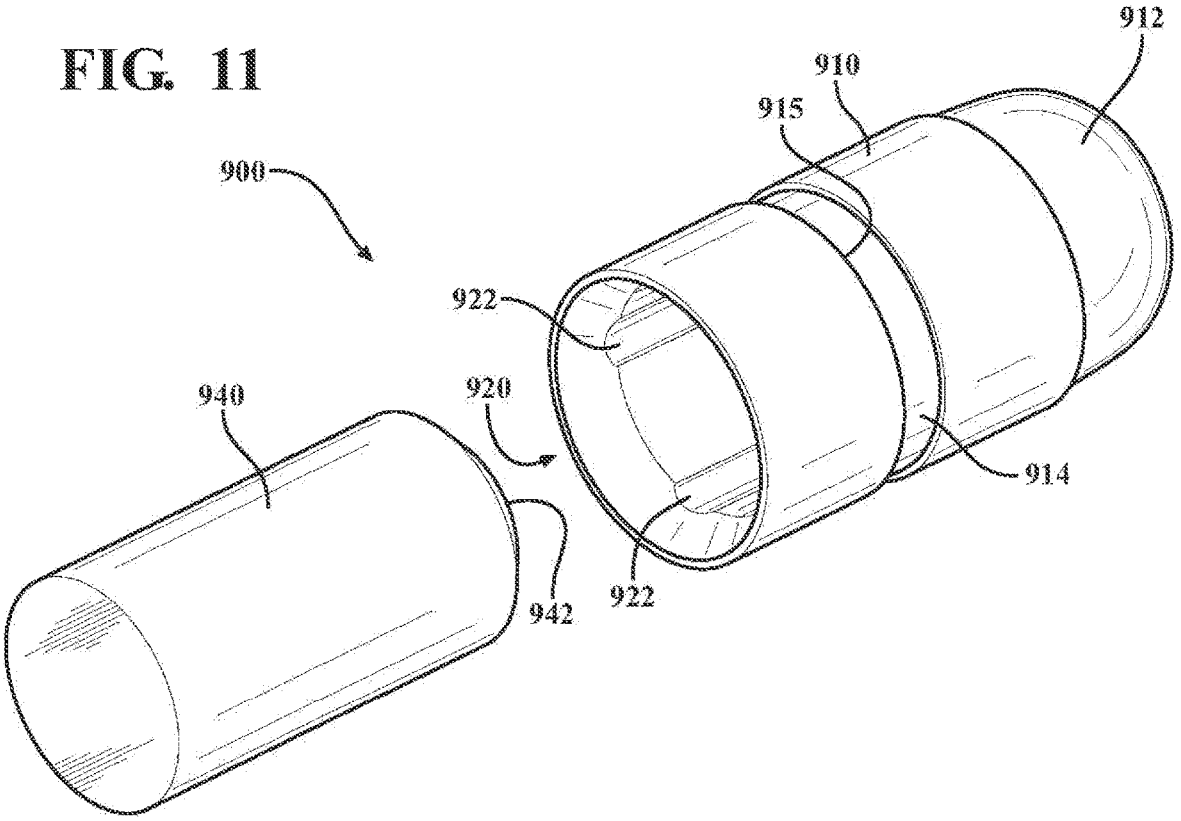
FIG. 11 schematically illustrates an exemplary alternative embodiment of an abrasive-binding agent composite slug including a bore rearward recess and a high-density insert operable to be inserted within the bore rearward recess, in accordance with the present disclosure.

FIG. 11 schematically illustrates an exemplary alternative embodiment of an abrasive-binding agent composite slug including a bore rearward recess. A two-piece slug assembly 900 is illustrated in a disassembled state, with a cylindrical high-density insert 940 outside of a bore rearward recess 920 of an abrasive-binding agent composite slug 910. While the high-density insert 940 of FIG. 11 is illustrated in a generally cylindrical shape, it will be appreciated that other non-cylindrical shapes may be utilized. The high-density insert 940 may be metallic, for example, constructed with lead, copper, zinc, steel, or other similar metals, or the high-density insert 940 may be constructed with stone, glass, a polymer, or other similar materials. The abrasive-binding agent composite slug 910 includes a tapered bore forward tip 912, an annular depressed groove 914 disposed about a mid-outer portion of the abrasive-binding agent composite slug 910, and the bore rearward recess 920. The abrasive-binding agent composite slug 910 may include a cylindrical portion configured to fit within a bore of a firearm. The bore rearward recess 920 may include one or more elongated inner grooves 922 running parallel to a longitudinal axis of the abrasive-binding agent composite slug 910. The inner grooves 922 may be useful as an assembly aid, providing for ease of inserting and removing a high-density insert to and from the bore rearward recess 920. In another embodiment, the inner grooves 922 may be omitted. The annular depressed groove 914 may additionally provide an edge 915 which is operable to increase scrubbing action upon the inner surface of the bore. The abrasive-binding agent composite slug 910 may include a binding agent such as a plastic or a polymer. The abrasive-binding agent composite slug 910 may further include an abrasive agent such as glass or fiberglass dispersed throughout the binding agent as a homogeneous or semi-homogeneous mixture.

The high-density insert 940 may include a tapered tip 942. The high-density insert 940 may be fully inserted within the bore rearward recess 920 to form the abrasive-binding agent composite slug 910. The abrasive-binding agent composite slug 910 may be fit within a brass casing pre-loaded with a propellant, similar to the device of FIG. 1.

Figure 12:
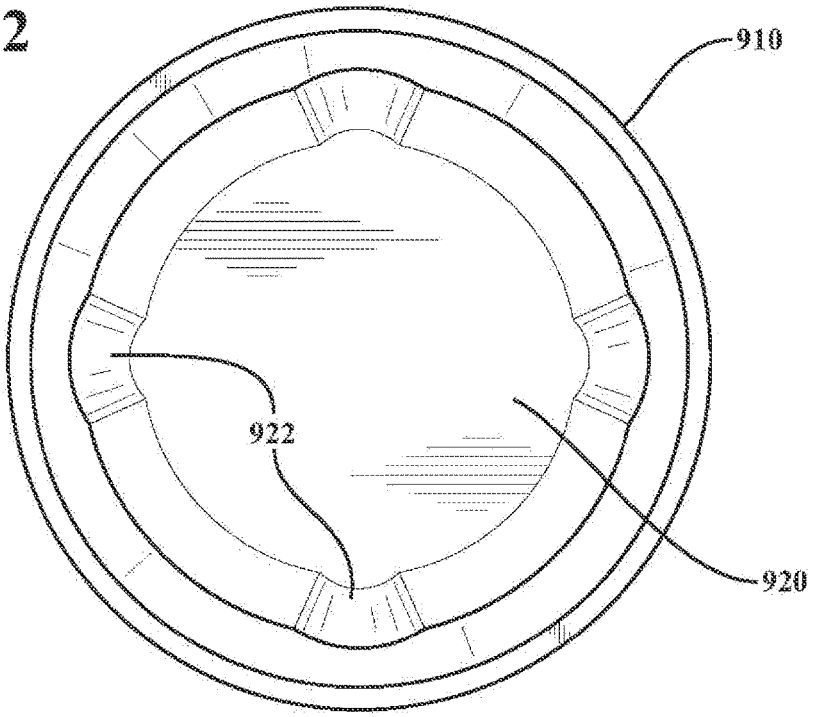
FIG. 12 schematically illustrates the abrasive-binding agent composite slug of FIG. 11 from a bore rearward view, in accordance with the present disclosure.
Figure 13:
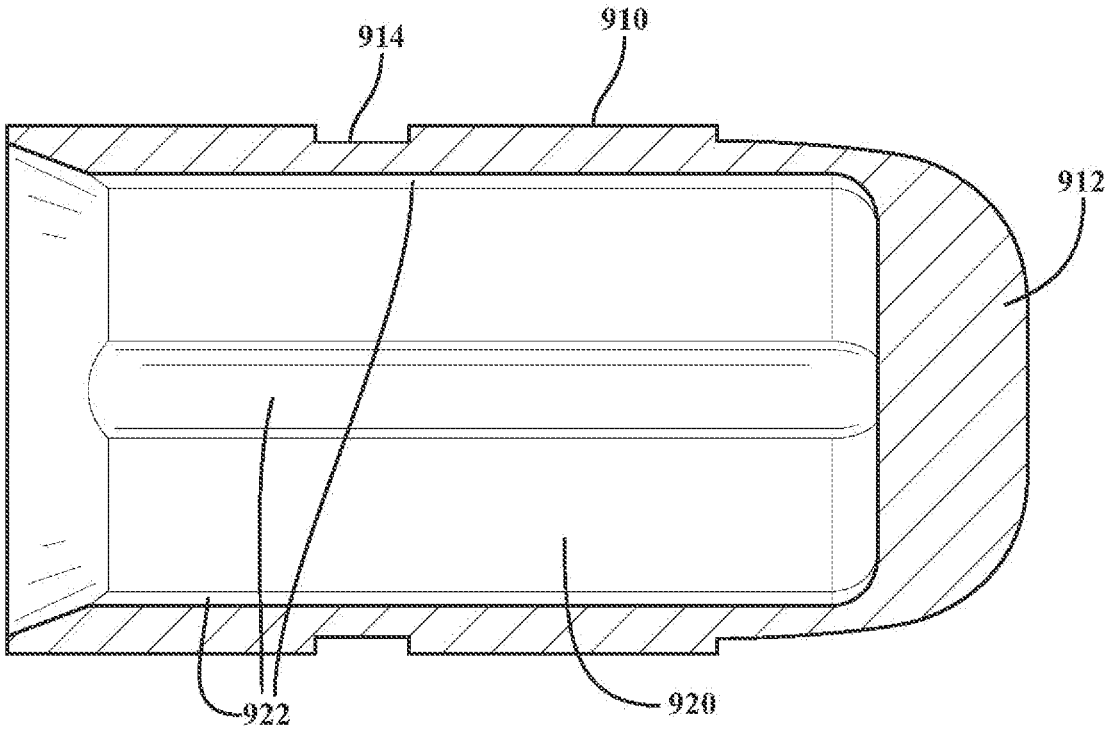
FIG. 13 schematically illustrates the abrasive-binding agent composite slug of FIG. 11 in a side sectional view, in accordance with the present disclosure.

FIG. 12 schematically illustrates the abrasive-binding agent composite slug of FIG. 11 from a bore rearward view. The abrasive-binding agent composite slug 910 is illustrated including the bore rearward recess 920. The bore rearward recess 920 includes four exemplary inner grooves 922. FIG. 13 schematically illustrates the abrasive-binding agent composite slug of FIG. 11 in a side sectional view. The abrasive-binding agent composite slug 910 is illustrated including the tapered bore forward tip 912 and the annular depressed groove 914. The bore rearward recess 920 is illustrated including a plurality of inner grooves 922.

Figure 14:
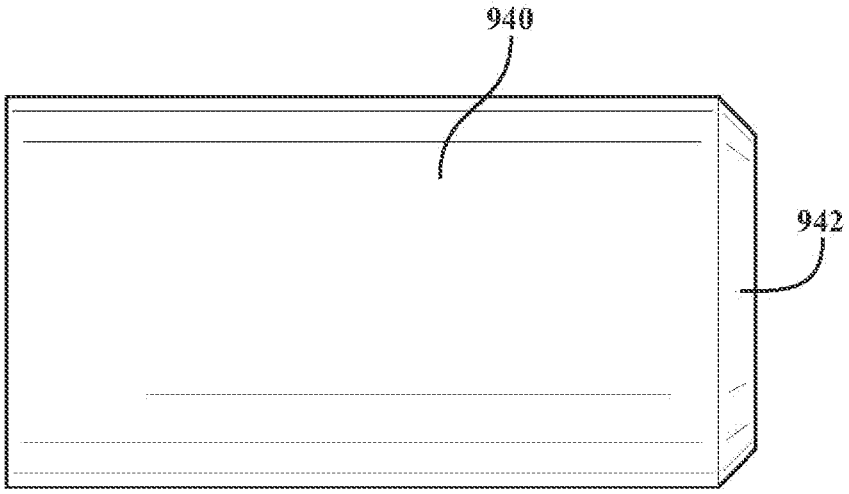
FIG. 14 schematically illustrates the high-density insert of FIG. 11 in a side view, in accordance with the present disclosure.

FIG. 14 schematically illustrates the insert of FIG. 11 in a side view. The high-density insert 940 is an embodiment of a high-density weight and includes the tapered tip 942 which may be useful to aid in inserting the high-density insert 940 into the bore rearward recess 920 of the abrasive-binding agent composite slug 910. The high-density insert 940 may be constructed with lead, steel, an alloy including multiple metals, a composite metallic structure, or other materials.

Figure 15:
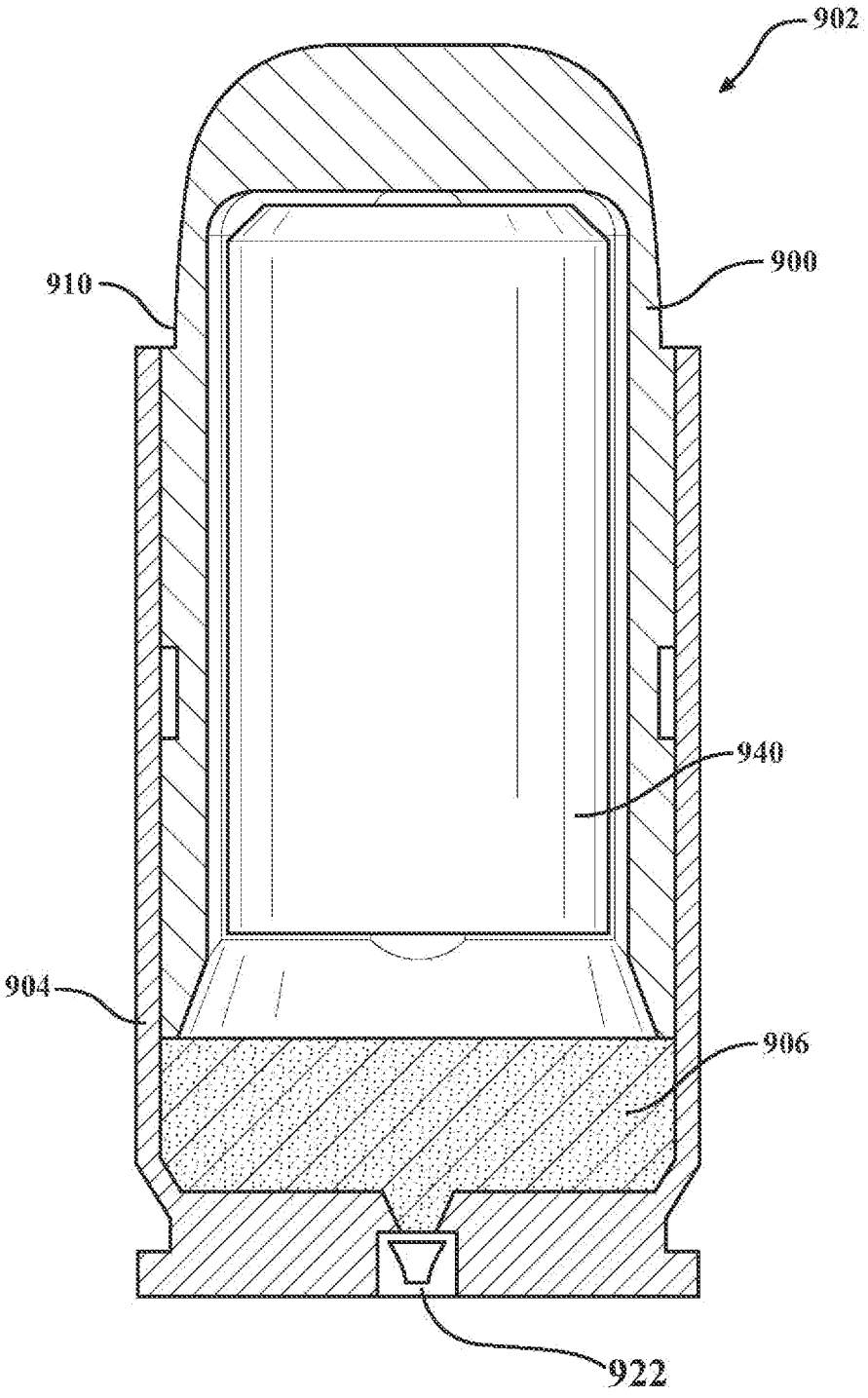
FIG. 15 schematically illustrates an exemplary ballistic barrel cleaning cartridge including the abrasive-binding agent composite slug and the high-density insert of FIG. 11, in accordance with the present disclosure.

FIG. 15 schematically illustrates an exemplary ballistic barrel cleaning cartridge including the abrasive-binding agent composite slug and the high-density insert of FIG. 11. A ballistic barrel cleaning cartridge 902 is illustrated, including casing 904, primer 922, propellant 906, and the two-piece slug assembly 900. Casing 904 may be made of brass, steel, or any other material in the art for ammunition casings. Casing 904 may include a primer 922 operable to create a spark when struck by a firing pin of a firearm. Casing 904 may be a centerfire casing or a rimfire casing. The two-piece slug assembly 900 includes the abrasive-binding agent composite slug 910 and the high-density insert 940. When the primer of the casing 904 creates a spark, the propellant 906 rapidly expands and applies pressure upon the two-piece slug assembly 900 which forces the two-piece slug assembly 900 down the bore of a firearm. The high-density insert 940 may include an outer diameter which permits the high-density insert 940 to easily be removed from the abrasive-binding agent composite slug 910. In another embodiment, the high-density insert 940 may include an outer diameter which is slightly larger than the inner diameter of the abrasive-binding agent composite slug 910, such that an interference fit is created between the parts.

Figure 16:
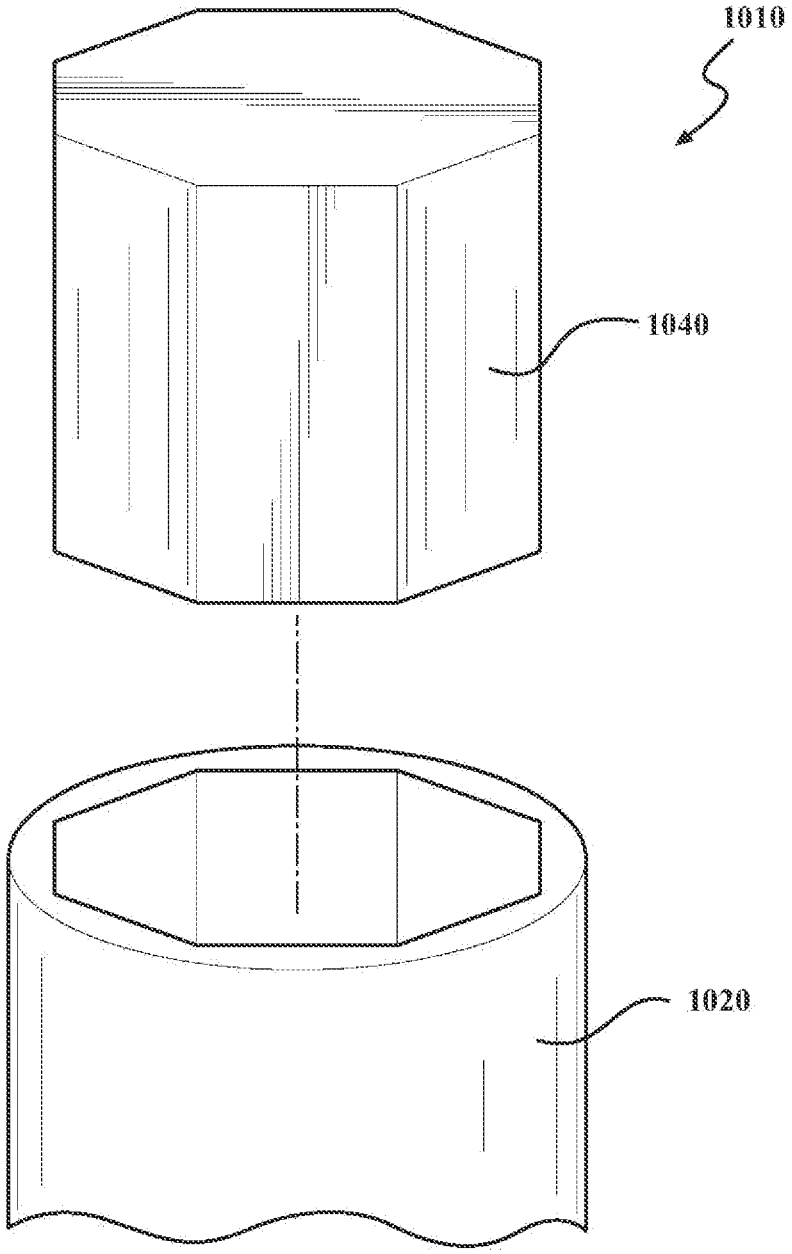
FIG. 16 schematically illustrates an alternative exemplary abrasive-binding agent composite slug with an octagonal cross section, in accordance with the present disclosure.

An abrasive-binding agent composite slug or a two-piece assembly including an abrasive-binding agent composite slug may be cylindrical in cross-section. Such a slug or assembly may alternatively have different cross-sectional shapes. FIG. 16 schematically illustrates an alternative exemplary abrasive-binding agent composite slug 1040 with an octagonal cross section. A configuration 1010 is illustrated including the abrasive-binding agent composite slug 1040 and a casing 1020 including a mating casing recess with the cross-sectional octagonal shape of the abrasive-binding agent composite slug 1040. A variety of cross-sectional shapes are envisioned, including square, triagonal, oval, and irregular shapes, and the disclosure is not intended to be limited to the examples provided herein.

Throughout the disclosure, a recess is intended to describe a feature upon a part or item. A recess may alternatively be described as an open end of an item, a walled-in enclosure with an open end, or a concave region of an item, or a feature or inner surface of an item operable to receive another item within the feature.

Figure 17:
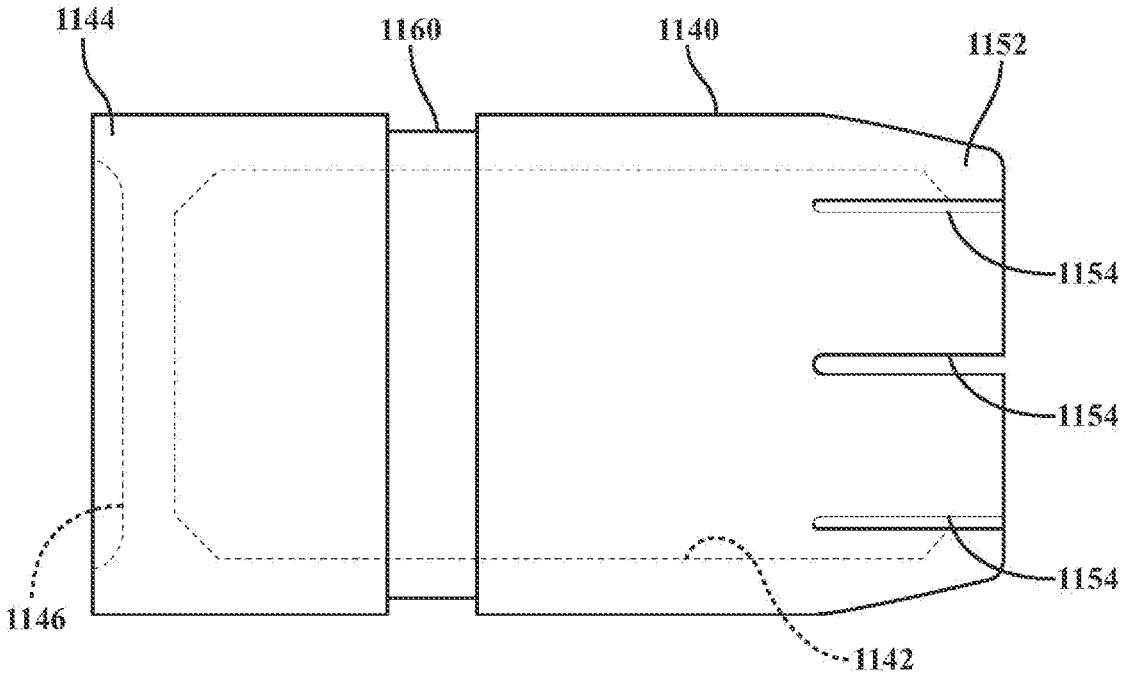
FIG. 17 schematically illustrates in side view an alternative exemplary embodiment of an abrasive-binding agent composite slug, including a recess configured for receiving a bore forward metallic weight, in accordance with the present disclosure.

FIG. 17 schematically illustrates in side view an alternative exemplary embodiment of an abrasive-binding agent composite slug 1140 similar to the abrasive-binding agent composite slug 440 of FIG. 5, including a recess 1142 configured for receiving a bore forward high-density weight. The abrasive-binding agent composite slug 1140 is configured as a handgun round, imitating a shape of a round such as a 9 mm Luger round. Interior features of the abrasive-binding agent composite slug 1140 are illustrated with broken lines for clarity. The recess 1142 is oriented bore forward, such that a bore forward high-density weight placed within the recess 1142 is exposed in a bore forward orientation as the abrasive-binding agent composite slug 1140 is propelled down the bore of a firearm. The abrasive-binding agent composite slug 1140 is illustrated including the recess 1142. The abrasive-binding agent composite slug 1140 includes a bore forward weight retention lip 1152 configured for holding a bore forward weight within the recess 1142. The bore forward weight retention lip 1152 includes a plurality of relief 1154 formed in the bore forward weight retention lip 1152, such that portions or gripping fingers of the bore forward weight retention lip 1152 may flex independently and enable easy installation and retention of a bore forward high-density weight into the recess 1142. The bore forward weight retention lip 1152 may include gripping features, teeth, undercut features, or any other similar features that are useful to engage with and retain the bore forward high-density weight and retain the weight within the recess 1142. The abrasive-binding agent composite slug 1140 further includes a rear portion 1144 including a concave gas seal recess 1146 configured for creating a gas seal. The abrasive-binding agent composite slug 1140 includes a generally cylindrical outer surface. The abrasive-binding agent composite slug 1140 further includes at least one annular exterior ring recess 1160 formed in the abrasive-binding agent composite slug 1140 configured for the purpose of aiding the abrasive-binding agent composite slug 1140 to engage with and clean a bore of a firearm.

Figure 18:
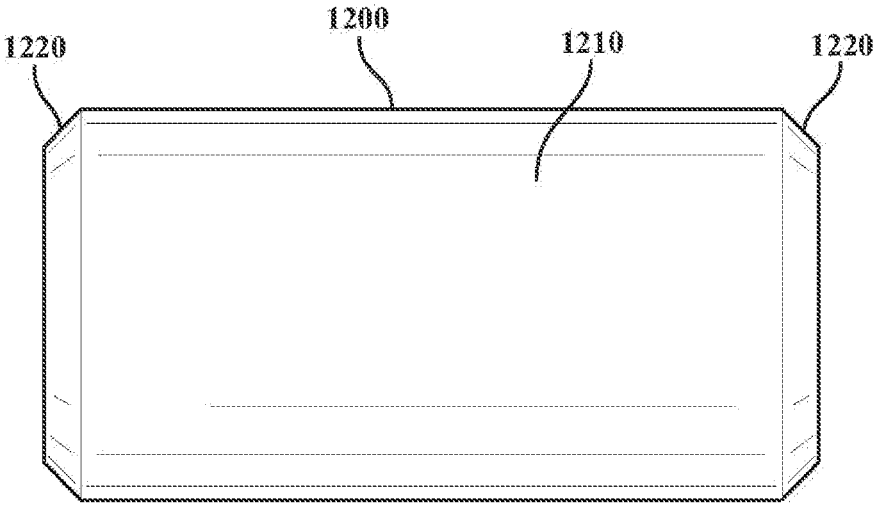
FIG. 18 schematically illustrates in side view a bore forward metallic weight configured for installation into the recess of the abrasive-binding agent composite slug of FIG. 17, in accordance with the present disclosure.

FIG. 18 schematically illustrates in side view a bore forward high-density weight 1200 configured for installation into the recess 1142 of the abrasive-binding agent composite slug 1140 of FIG. 17. The bore forward high-density weight 1200 includes a cylindrical central portion 1210. The bore forward high-density weight 1200 may include beveled portions 1220 at forward and rearward portions of the bore forward high-density weight 1200 as assembly aids to make it easy for one to press the bore forward high-density weight 1200 into the recess 1142 of FIG. 17.

Figure 19:
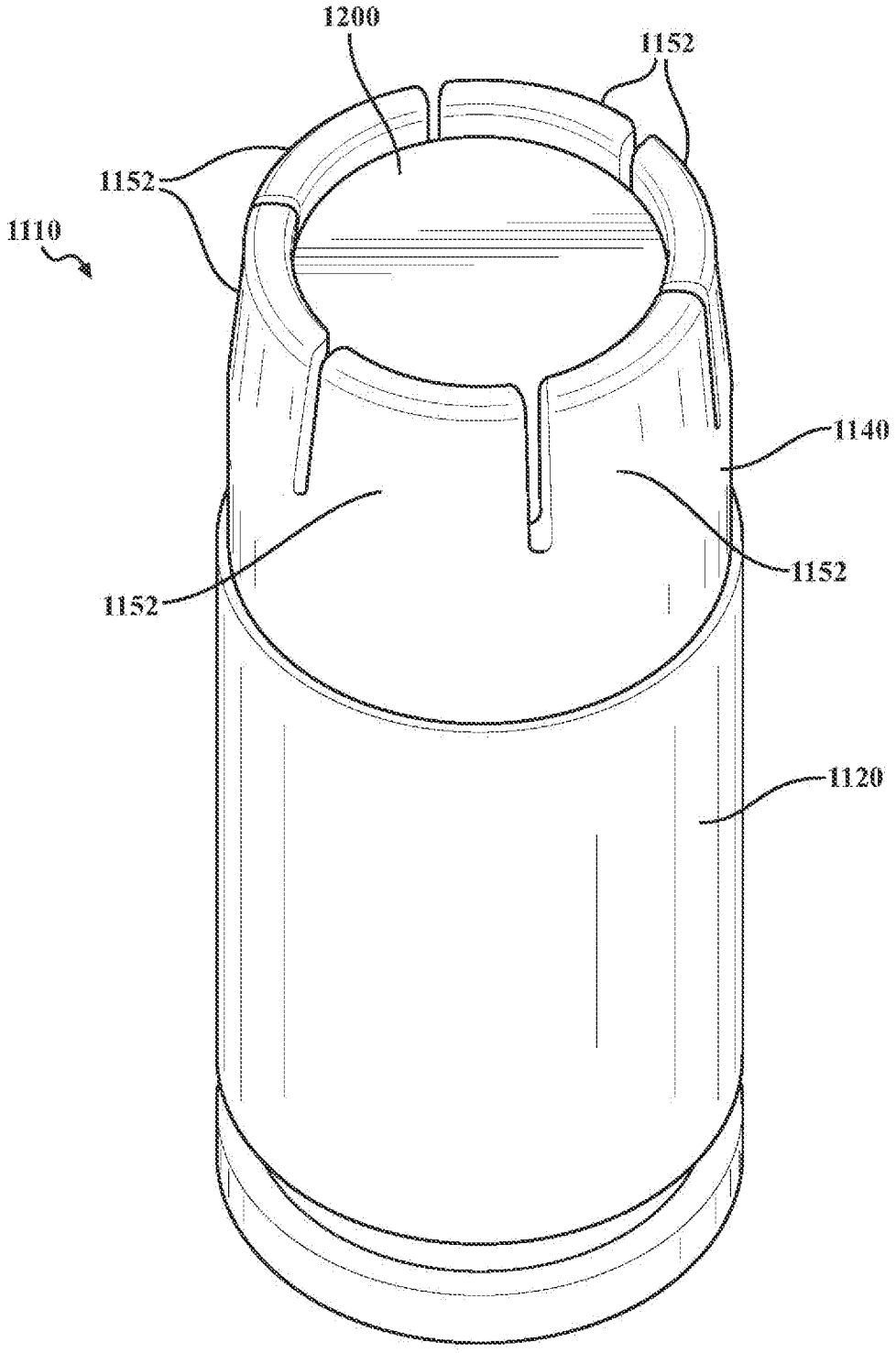
FIG. 19 schematically illustrates in perspective view a ballistic barrel cleaning cartridge including the abrasive-binding agent composite slug of FIG. 17 and the bore forward metallic weight of FIG. 18 within a brass casing, in accordance with the present disclosure.

FIG. 19 schematically illustrates in perspective view a ballistic barrel cleaning cartridge 1110 including the abrasive-binding agent composite slug 1140 of FIG. 17 and the bore forward high-density weight 1200 of FIG. 18 within a brass casing 1120. The abrasive-binding agent composite slug 1140 is illustrated including six of the bore forward weight retention lips 1152 holding the bore forward high-density weight 1200 in place within the abrasive-binding agent composite slug 1140. A propellent is disposed within the brass casing 1120 between the brass casing 1120 and the abrasive-binding agent composite slug 1140.

Figure 20:
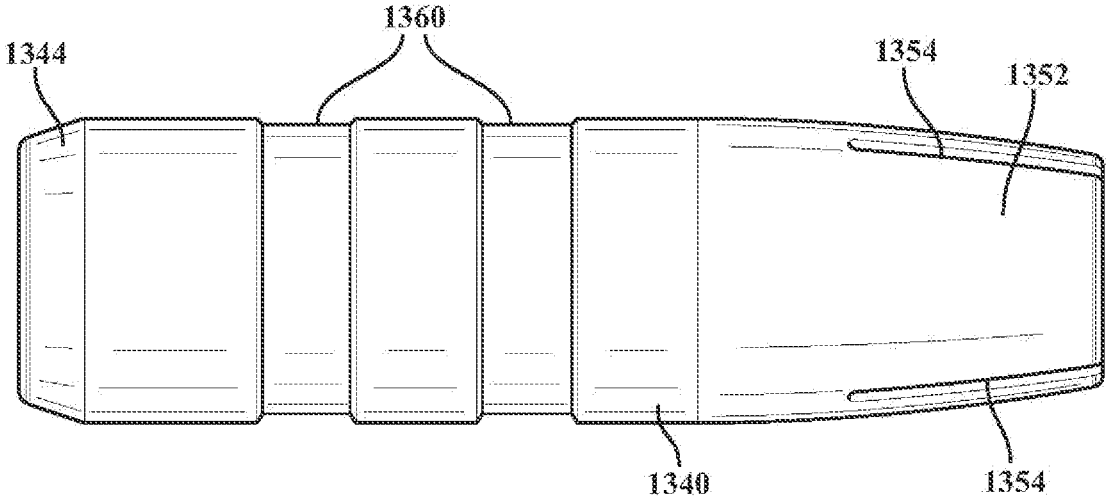
FIG. 20 schematically illustrates in side view an alternative exemplary embodiment of an abrasive-binding agent composite slug similar to the abrasive-binding agent composite slug of FIG. 5 and the abrasive-binding agent composite slug of FIG. 17, including a recess configured for receiving a bore forward high-density weight, in accordance with the present disclosure.

FIG. 20 schematically illustrates in side view an alternative exemplary embodiment of an abrasive-binding agent composite slug 1340 similar to the abrasive-binding agent composite slug 440 of FIG. 5 and the abrasive-binding agent composite slug 1140 of FIG. 17, including a recess configured for receiving a bore forward high-density weight. The abrasive-binding agent composite slug 1340 is configured as a rifle round, imitating a shape of a round such as a 0.223

Remington round. The abrasive-binding agent composite slug 1340 includes a bore forward weight retention lip 1352 configured for holding a bore forward weight within the recess of the abrasive-binding agent composite slug 1340. The bore forward weight retention lip 1352 includes a plurality of reliefs 1354 formed in the bore forward weight retention lip 1352, such that portions or gripping fingers of the bore forward weight retention lip 1352 may flex independently and enable easy installation of a bore forward high-density weight into the recess of the abrasive-binding agent composite slug 1340. The abrasive-binding agent composite slug 1340 further includes a rear portion 1344. The abrasive-binding agent composite slug 1340 includes a generally cylindrical outer surface. The abrasive-binding agent composite slug 1340 further includes at two exemplary annular exterior ring recesses 1360 formed in the abrasive-binding agent composite slug 1340 configured for the purpose of aiding the abrasive-binding agent composite slug 1340 to engage with and clean a bore of a firearm.

Figure 21:
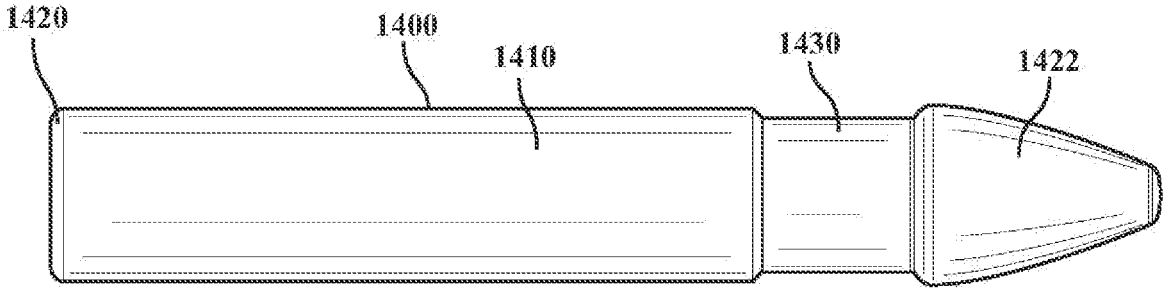
FIG. 21 schematically illustrates in side view a bore forward high-density weight configured for installation into the recess of the abrasive-binding agent composite slug of FIG. 22, in accordance with the present disclosure.
Figure 22:
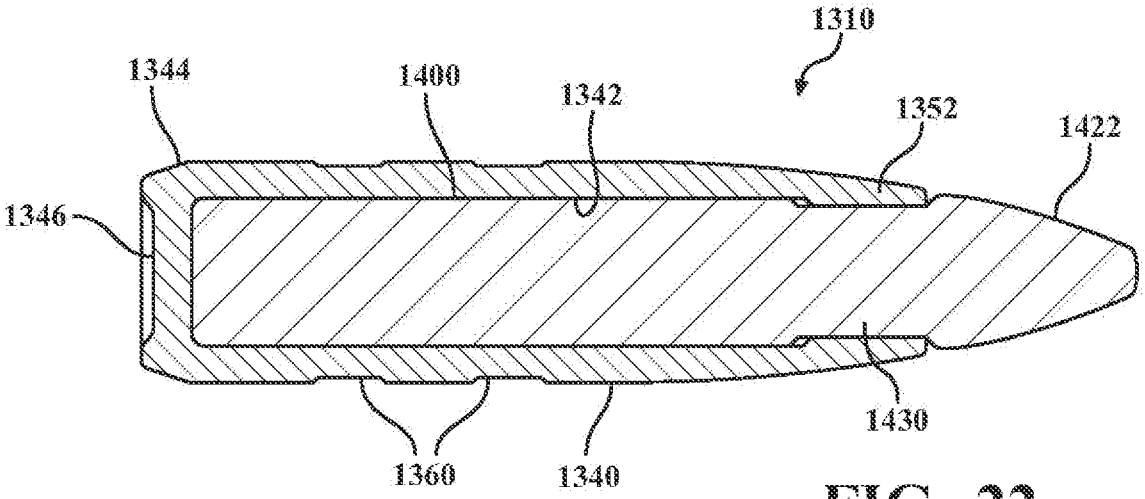
FIG. 22 schematically illustrates in side cross-sectional view the abrasive-binding agent composite slug of FIG. 20 and the bore forward high-density weight of FIG. 21 installed thereto, in accordance with the present disclosure.

FIG. 21 schematically illustrates in side view a bore forward high-density weight 1400 configured for installation into the recess 1342 of the abrasive-binding agent composite slug 1340 of FIG. 22. The bore forward high-density weight 1400 includes a cylindrical central portion 1410. The bore forward high-density weight 1400 may include beveled portion 1420 at a rearward portion of the bore forward high-density weight 1400 as assembly aids to make it easy for one to press the bore forward high-density weight 1400 into the recess 1342 of FIG. 22. The bore forward high-density weight 1400 further includes a pointed tip 1422 which may be useful for imitating an outline or shape of a round of ammunition and thereby conforming to features within a firearm useful for smoothly loading the disclosed ballistic bore cleaning cartridge into a chamber of the firearm being cleaned without the ballistic bore cleaning cartridge jamming in a feeding mechanism. The bore forward high-density weight 1400 further includes an annular exterior ring recess 1430 configured for matching with features of the bore forward weight retention lips 1352 of FIG. 22 in order to retain the bore forward high-density weight 1400 within the recess 1342.

FIG. 22 schematically illustrates in side cross-sectional view the abrasive-binding agent composite slug 1340 of FIG. 20 and the bore forward high-density weight 1400 of FIG. 21 installed thereto. A projectile portion 1310 of a ballistic barrel cleaning cartridge is illustrated. A recess 1342 of the abrasive-binding agent composite slug 1340 is illustrated oriented bore forward, such that the bore forward high-density weight 1400 placed within the recess 1342 is exposed in a bore forward orientation as the abrasive-binding agent composite slug 1340 is propelled down the bore of a firearm. The abrasive-binding agent composite slug 1340 includes a bore forward weight retention lip 1352 that fits within the annular exterior ring recess 1430 and is configured for holding a bore forward weight within the recess 1342. The bore forward weight retention lip 1352 may include gripping features, teeth, undercut features, or any other similar features that are useful to engage with and retain the bore forward high-density weight 1400 and retain the weight within the recess 1142. The abrasive-binding agent composite slug 1340 further includes the rear portion 1344 including a concave gas seal recess 1346 configured for creating a gas seal. The abrasive-binding agent composite slug 1340 further includes the two annular exterior ring recesses 1360. The pointed tip 1422 of the bore forward high-density weight 1400 is illustrated exposed outside of the recess 1342.

Figure 23:
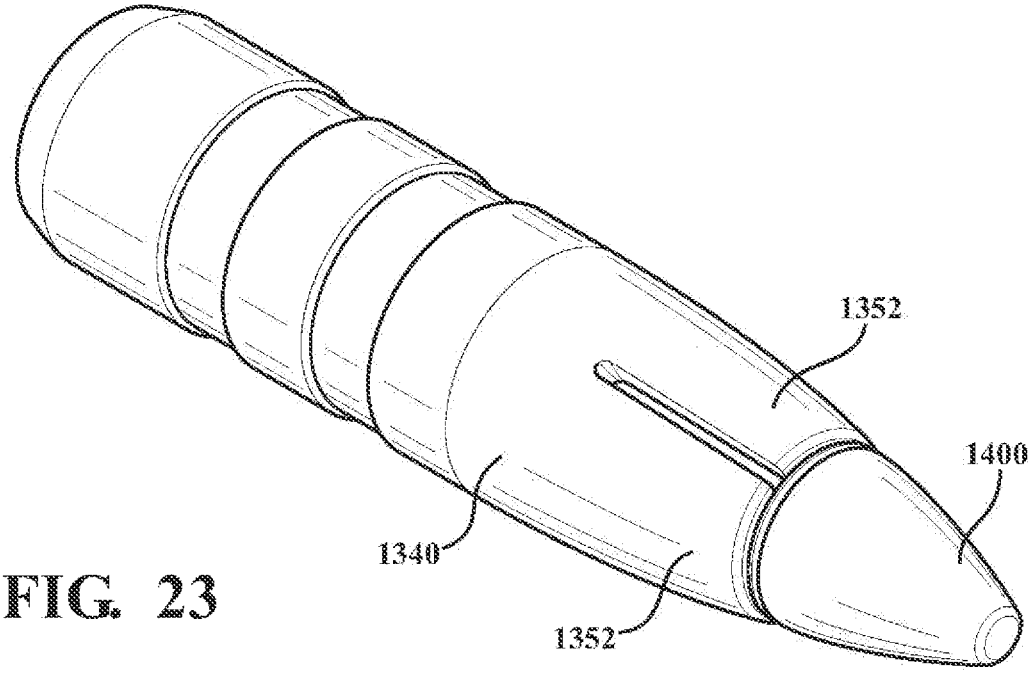
FIG. 23 schematically illustrates in perspective view the abrasive-binding agent composite slug of FIG. 20 with the bore forward high-density weight of FIG. 21 installed thereto, in accordance with the present disclosure.

FIG. 23 schematically illustrates in perspective view the abrasive-binding agent composite slug 1340 of FIG. 20 with the bore forward high-density weight 1400 of FIG. 21 installed thereto. In order to be utilized as a ballistic bore cleaning cartridge, the illustrated abrasive-binding agent composite slug 1340 and the bore forward high-density weight 1400 may be disposed within a corresponding brass casing, with a calibrated load of propellent provided between the abrasive-binding agent composite slug 1340 and the brass casing. The abrasive-binding agent composite slug 1340 is illustrated including a plurality of the bore forward weight retention lips 1352 holding the bore forward high-density weight 1400 in place within the abrasive-binding agent composite slug 1340.

High-density weights described throughout the disclosure may be metallic. Exemplary metallic weights described in various embodiments may be replaced by non-metallic high density weights, such as with a stone or glass pellet.

While the best modes for carrying out the disclosure have been described in detail, those familiar with the art to which this disclosure relates will recognize various alternative designs and embodiments for practicing the disclosure within the scope of the appended claims.

The invention claimed is:

1. A ballistic barrel cleaning cartridge, comprising:

a casing including a casing recess, wherein the casing recess is closed at a first end of the casing;

a propellant disposed within the casing recess;

an abrasive-binding agent composite slug constructed with an abrasive agent and a polymerized binding agent, wherein the abrasive-binding agent composite slug is disposed within the casing recess at a second end of the casing and wherein the abrasive-binding agent composite slug includes:

a bore forward recess configured for receiving a bore forward metallic high-density weight; and a retention lip configured for retaining the bore forward metallic high-density weight within the bore forward recess; and the bore forward metallic high-density weight; and wherein expansion of the propellant is operable to expel the abrasive-binding agent composite slug from the casing recess; and wherein the abrasive agent at a surface of the abrasive-binding agent composite slug is configured for scrubbing a bore of a firearm.

2. The ballistic barrel cleaning cartridge of claim 1, wherein the abrasive agent includes fiberglass.

3. The ballistic barrel cleaning cartridge of claim 1, wherein the abrasive agent includes glass.

4. The ballistic barrel cleaning cartridge of claim 1, wherein the polymerized binding agent includes nylon.

5. The ballistic barrel cleaning cartridge of claim 1, wherein the polymerized binding agent includes one of acrylonitrile butadiene styrene, polypropylene, or polyethylene.

6. The ballistic barrel cleaning cartridge of claim 1, wherein the bore forward metallic high-density weight includes a mass per unit volume greater than a mass per unit volume of the abrasive-binding agent composite slug.

7. The ballistic barrel cleaning cartridge of claim 1, wherein a rear portion of the abrasive-binding agent composite slug is concave.

8. The ballistic barrel cleaning cartridge of claim 1, wherein the abrasive agent is interspersed within the polymerized binding agent.

9. The ballistic barrel cleaning cartridge of claim 1, wherein the casing recess is cylindrically shaped; and wherein the abrasive-binding agent composite slug is cylindrically shaped.

10. The ballistic barrel cleaning cartridge of claim 1, wherein the bore forward metallic high-density weight includes a recess configured for engaging with the retention lip.

11. The ballistic barrel cleaning cartridge of claim 1, wherein the bore forward metallic high-density weight includes a pointed tip configured for enabling the ballistic barrel cleaning cartridge to be fed into a chamber of the firearm.

12. The ballistic barrel cleaning cartridge of claim 1, wherein the bore forward recess is conical-shaped.

13. The ballistic barrel cleaning cartridge of claim 1, wherein the bore forward recess is cylindrically-shaped.

14. A ballistic barrel cleaning cartridge, comprising:

a casing including a casing recess, wherein the casing recess is closed at a first end of the casing;

a propellant disposed within the casing recess;

an abrasive-binding agent composite slug constructed with an abrasive agent and a polymerized binding agent, wherein the abrasive-binding agent composite slug is disposed within the casing recess at a second end of the casing and wherein the abrasive-binding agent composite slug includes:

a bore forward recess configured for receiving a bore forward metallic weight; and a retention lip configured for retaining the bore forward metallic weight within the bore forward recess; and the bore forward metallic weight; and wherein expansion of the propellant is operable to expel the abrasive-binding agent composite slug from the casing recess;

wherein the abrasive agent includes one of fiberglass or glass;

wherein the polymerized binding agent includes one of nylon, acrylonitrile butadiene styrene, polypropylene, or polyethylene; and wherein the abrasive agent at a surface of the abrasive-binding agent composite slug is configured for scrubbing a bore of a firearm.

15. The ballistic barrel cleaning cartridge of claim 14, wherein the abrasive agent is interspersed within the polymerized binding agent.

16. The ballistic barrel cleaning cartridge of claim 14, wherein the casing recess is cylindrically shaped; and wherein the abrasive-binding agent composite slug is cylindrically shaped.

17. The ballistic barrel cleaning cartridge of claim 14, wherein the bore forward metallic weight includes a recess configured for engaging with the retention lip.

18. The ballistic barrel cleaning cartridge of claim 14, wherein the bore forward metallic weight includes a pointed tip configured for enabling the ballistic barrel cleaning cartridge to be fed into a chamber of the firearm.

* * * * *